US010309633B2

(12) United States Patent
Harnett

(10) Patent No.: US 10,309,633 B2
(45) Date of Patent: Jun. 4, 2019

(54) MOUTH ACTIVATED LIGHT DEVICE

(71) Applicant: Chase Harnett, Englewood, NJ (US)

(72) Inventor: Chase Harnett, Englewood, NJ (US)

( * ) Notice: Subject to any disclaimer, the term of this patent is extended or adjusted under 35 U.S.C. 154(b) by 0 days.

(21) Appl. No.: 15/892,530

(22) Filed: Feb. 9, 2018

(65) Prior Publication Data

US 2018/0224110 A1 Aug. 9, 2018

Related U.S. Application Data

(60) Provisional application No. 62/456,972, filed on Feb. 9, 2017.

(51) Int. Cl.

| | |
|---|---|
| ***F21V 23/04*** | (2006.01) |
| ***F21L 4/02*** | (2006.01) |
| ***F21V 15/01*** | (2006.01) |
| ***F21V 31/00*** | (2006.01) |
| ***F21V 17/12*** | (2006.01) |
| ***F21L 4/00*** | (2006.01) |
| *F21Y 115/10* | (2016.01) |
| *F21W 131/20* | (2006.01) |
| *F21W 131/402* | (2006.01) |

(52) U.S. Cl.

CPC ..... *F21V 23/0414* (2013.01); *F21L 4/00* (2013.01); *F21L 4/02* (2013.01); *F21V 15/01* (2013.01); *F21V 17/12* (2013.01); *F21V 23/0421* (2013.01); *F21V 31/00* (2013.01); *F21W 2131/20* (2013.01); *F21W 2131/402* (2013.01); *F21Y 2115/10* (2016.08)

(58) Field of Classification Search

CPC ..... F21V 23/0414; F21V 31/00; F21V 17/12; F21V 15/01

See application file for complete search history.

(56) References Cited

U.S. PATENT DOCUMENTS

| | | | | |
|---|---|---|---|---|
| 2011/0162949 | A1* | 7/2011 | Dimig | E05B 19/0082 200/505 |
| 2015/0223355 | A1* | 8/2015 | Fleck | G06F 1/163 361/679.03 |
| 2017/0251561 | A1* | 8/2017 | Fleck | G06F 1/163 |
| 2018/0368557 | A1* | 12/2018 | Kaiser | A45D 42/10 |

* cited by examiner

*Primary Examiner* — Joseph L Williams

(74) *Attorney, Agent, or Firm* — Mintz Levin Cohn Ferris Glovsky and Popeo, P.C.

(57) ABSTRACT

A device is described that can include a first housing and a second housing. The first housing can encompass a first tact switch. The second housing can be attached to and be continuous with the first housing. The second housing can encompass a second tact switch, a battery and one or more light emitting diodes. The first tact switch can be electrically connected to the battery and the one or more light emitting diodes. The second tact switch can be electrically connected to the battery and the one or more light emitting diodes. The battery can be further connected to the one or more light emitting diodes. Each of the first tact switch and the second tact switch can be activated upon being pressurized by an external force upon a portion of the first housing or the second housing, respectively, to activate the one or more light emitting diodes.

20 Claims, 14 Drawing Sheets

MOUTH ACTIVATED LIGHT DEVICE

CROSS-REFERENCE TO RELATED ACTIONS

This application claims priority under 35 U.S.C. § 119(e) to U.S. Provisional Application No. 62/456,972 filed on Feb. 9, 2017 and entitled "Light Device," which is hereby expressly incorporated by reference herein in its entirety.

TECHNICAL FIELD

The subject matter described herein relates to a light device that can be operated by a mouth of a user.

BACKGROUND

Many tasks occurring in the absence of natural light require sufficient lighting for the task to be performed efficiently. To overcome the deficiency caused by the absence of natural light, users often use a hand-held torch or flashlight. But when an activity requires a constant or consistent use of hands, using a hand-held torch is not optimal. For example, fishermen often need instant illumination at various times at night, but their hands are usually engaged with fishing and other activities, thereby rendering a hand-held flash light inconvenient. In another example, mechanics and/or engineers frequently are engaged with both hands in tight spaces, and cannot use a hand-held flashlight without being bothered. In yet another example, emergency medical technicians often carry hand-held flashlights, but using them is not easy when those technicians have both their hands occupied with other things, such as caring for the patient. Hand-held flashlights are therefore problematic for many people in a variety of situations that engage both the hands of a user.

SUMMARY

In one aspect, a device is described that can include a first housing and a second housing. The first housing can encompass a first tact switch. The second housing can be attached to and be continuous with the first housing. The second housing can encompass a second tact switch, a battery and one or more light emitting diodes. The first tact switch can be electrically connected to the battery and the one or more light emitting diodes. The second tact switch can be electrically connected to the battery and the one or more light emitting diodes. The battery can be further connected to the one or more light emitting diodes. Each of the first tact switch and the second tact switch can be configured to be activated upon being pressurized by an external force upon a portion of the first housing or the second housing, respectively, to activate the one or more light emitting diodes.

In some variations, one or more of the following can be implemented either individually or in any suitable combination. The each of the first tact switch and the second tact switch can be configured to be deactivated upon being pressurized by at least one external force upon the portion of the first housing or the second housing, respectively. The deactivated tact switch can deactivate the one or more light emitting diodes. The first housing can be configured to fit within a mouth of a user. The first tact switch can be configured to be activated or deactivated by force applied by mandibles of a user. The first housing can be encompassed with a replaceable sleeve. The first housing and replaceable sleeve can mate via a ridge on the first housing and a groove on the replaceable sleeve. The first housing and replaceable sleeve can mate via a groove on the first housing and a ridge on the replaceable sleeve. The first housing can be made of plastic. The first housing can be a replaceable sleeve. The first housing can be made of rubber. The second tact switch can be configured to be activated or deactivated by force applied by one or more fingers of a user.

The second housing can be made of plastic. The second housing can be water-proof. The first housing can be water-proof. A combination of the second housing and the first housing can include two separate halves along a length of the light device. The two halves can be combined via screws and grooves. A combination of the second housing and the first housing can have a length of two inches. The second housing can have a width of 0.75 inches. A combination of the second housing and the first housing can be incorporated within a mask configured to be worn by a user. The one or more light emitting diodes can include a plurality of light emitting diodes. The plurality of the light emitting diodes can be placed at a plurality of locations within a combination of the second housing and the first housing. The plurality of locations can include two ends along a length of a combination of the second housing and the first housing.

The details of one or more variations of the subject matter described herein are set forth in the accompanying drawings and the description below. Other features and advantages of the subject matter described herein will be apparent from the description, the drawings, and the claims.

DESCRIPTION OF DRAWINGS

Like reference symbols in the various drawings indicate like elements.

DETAILED DESCRIPTION

Figure 1:
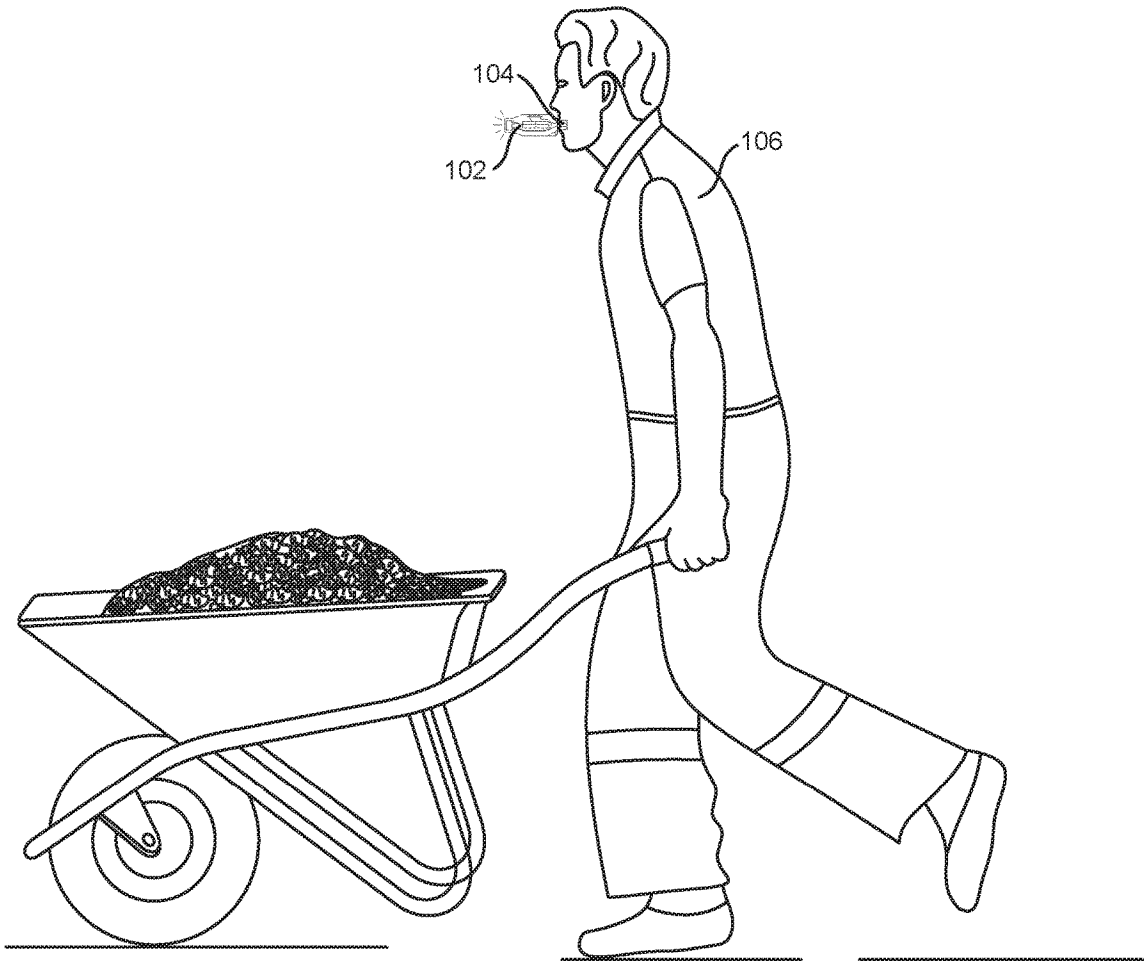
FIG. 1 is a light device configured to be operated via a mouth of a user.

FIG. 1 illustrates a light device 102 configured to be operated via a mouth 104 of a user 106. In this example, the user 106 is a worker with both his hands occupied. The operation of the light device 102 via the mouth 104 prevents the worker from getting distracted or inconvenienced when he needs flashlight while using both his hands.

Figure 2:
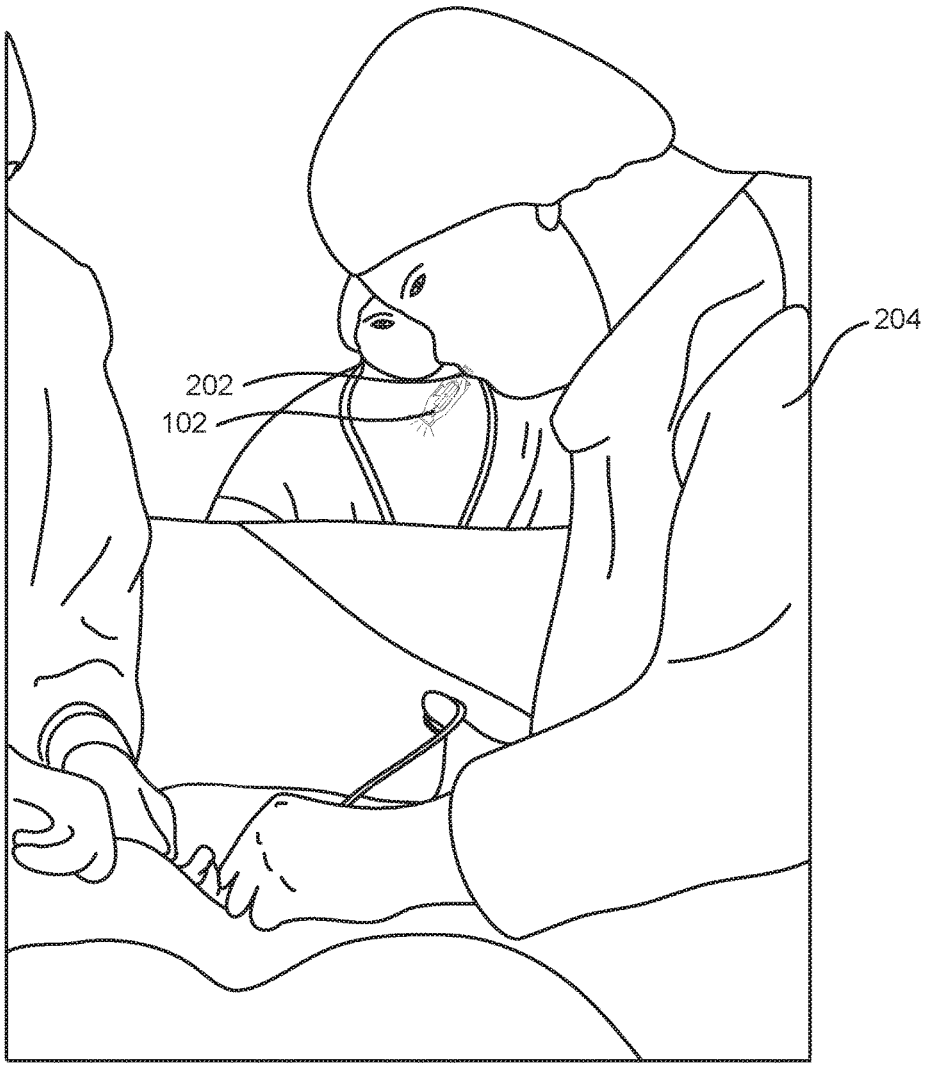
FIG. 2 is a light device configured to be operated via a mouth of another user.

FIG. 2 illustrates a light device 102 configured to be operated via a mouth 202 of another user 204. Here, the user 204 is a surgeon who has both his hands occupied in a surgery. The operation of the light device 102 via the mouth 204 prevents the surgeon from getting distracted or inconvenienced when he needs flashlight while operating with both his hands.

Figure 3:
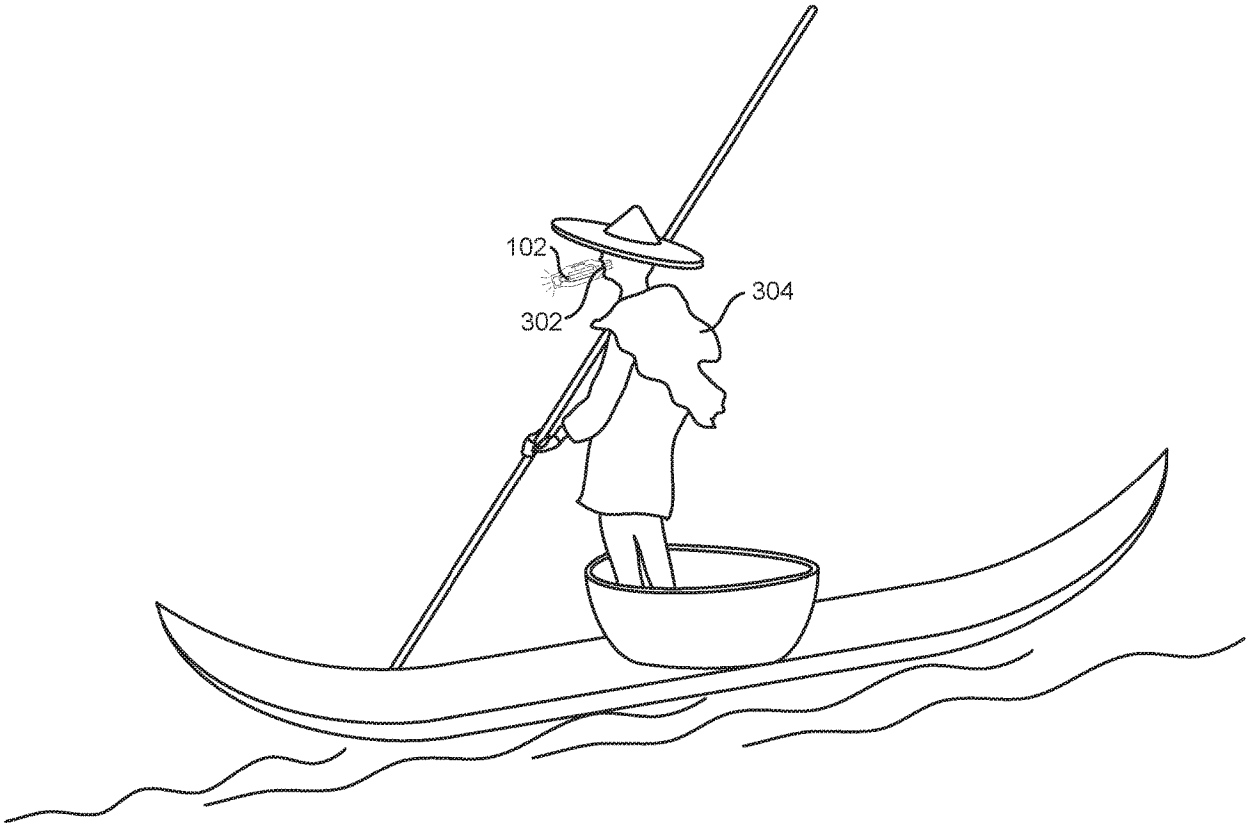
FIG. 3 is a light device configured to be operated via a mouth of a another user.

FIG. 3 illustrates a light device 102 configured to be operated via a mouth 302 of a yet another user 304. Here, the user 304 is a fisherman who has both his hands occupied with rowing his boat. The operation of the light device 102 via the mouth 304 prevents the fisherman from getting distracted or inconvenienced when he needs flashlight while rowing with both his hands.

Figure 4:
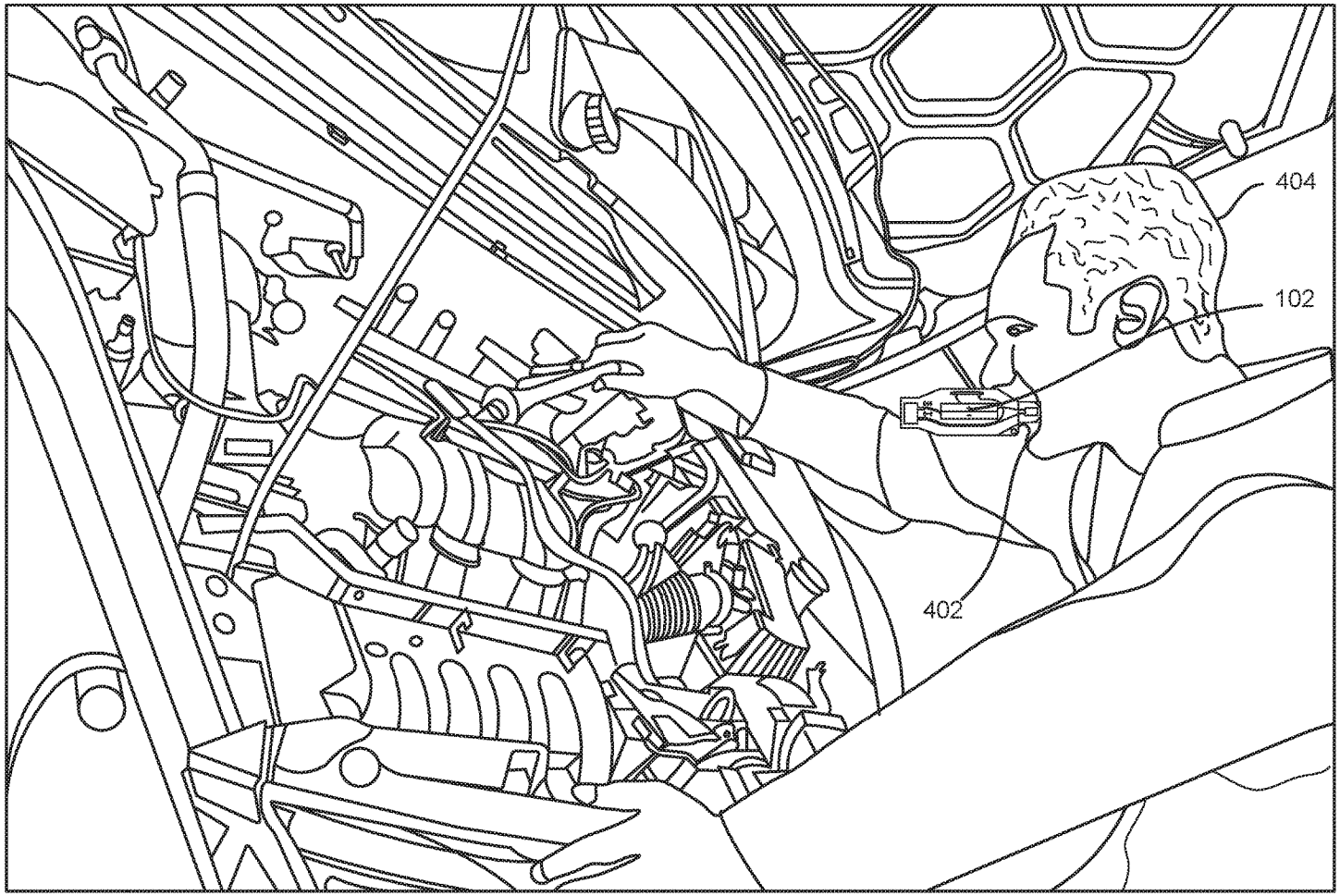
FIG. 4 is a light device configured to be operated via a mouth of another user.

FIG. 4 illustrates a light device 102 configured to be operated via a mouth 402 of another user 404. Here, the user 404 is a mechanic who has both his hands occupied with examining a vehicle. The operation of the light device 102 via the mouth 404 prevents the mechanic from getting inconvenienced when he needs flashlight while checking the vehicle.

It may be noted that the examples of the worker, surgeon, fisherman and mechanic are merely exemplary. Other users who have both their hands engaged can also benefit from the light device 102. For example, this light can benefit an emergency medical technician, an engineer, or any other person whose hands are often occupied. While the people who have their hands occupied can benefit the most from the light device 102, other individuals who do not need their hands can also benefit from the light device 102.

Figure 5:
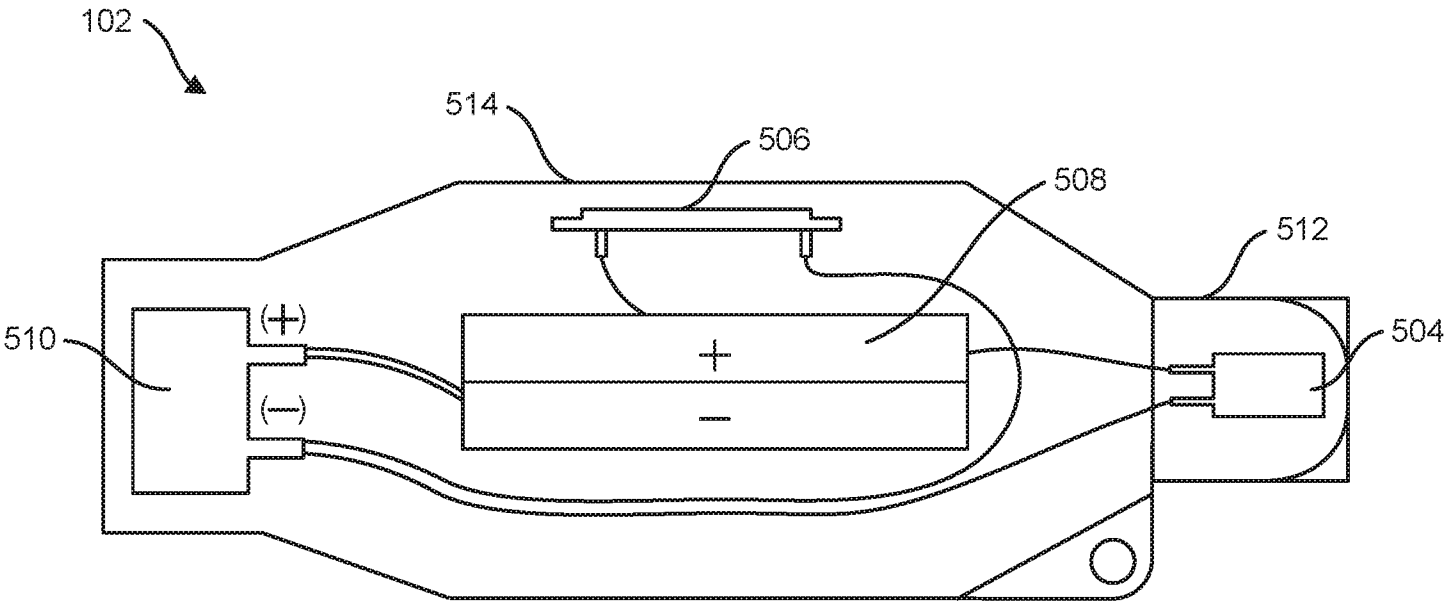
FIG. 5 is a detailed side view of the light device shown in FIGS. 1-4.

FIG. 5 shows a detailed view of the light device 102. The light device 102 includes a first tact switch 504, a second tact switch 506, a battery 508, one or more light emitting diodes 510, a first housing 512 partially encompassing the first tact switch 504, and a second housing 514 partially encompassing the second tact switch 506, the battery 508 and the one or more light emitting diodes 510. The first tact switch 504 is electrically connected to the battery 508 and the one or more light emitting diodes 510. The second tact switch 506 is also electrically connected to the battery 508 and the one or more light emitting diodes 510. In one implementation, the battery 508 can be rechargeable such that it is recharged by a power source. While the light device 102 is described as including one or more light emitting diodes 510, in other implementations the light device 102 can additionally or alternately incorporate other sources of light, such as laser light.

The first housing 512 is configured to fit within the mouth of an individual, such as user 106, 204, 304, or the like. When that individual presses on the first housing 512 with his or her mandibles, the first tact switch 504 is pressed and activated. The activation of the first tact switch 504 activates the one or more light emitting diodes 510. Thus, the individual is able to activate the one or more light emitting diodes 510 without using his or her hands. If the light is activated or on, pressing the first housing 512 again can deactivate or turn off the already activated light.

The second housing 514 incorporates a button 602 (described below with respect to FIG. 6) that can be pressed down by the user's hand. The button 602 overlies and is electrically connected to the second tact switch 506. When the button 602 is pressed, the second tact switch 506 also gets pressed and activated. The activation of the second tact switch 506 activates the one or more light emitting diodes 510. Thus, the individual is able to activate the one or more light emitting diodes 510 by using his or her hands as well, if required or desired so by that individual. While the button 602 is described here as being actuated by the hands of a user, any other body part or external thing can alternately be used as a substitute for the hands. If the light is activated or on, pressing the button 602 again can deactivate or turn off the already activated light.

The light device 102 thus provides a user the option of using either the mouth or the hands (or any alternate body part or external thing, as discussed above) to activate or deactivate the one or more light emitting diodes 510. This enhances convenience of a user. The first tact switch 504 as well as the second tact switch 506 is configured such that the tactile press thereon can be firm enough to avoid accidental triggering but light enough to ensure ease of use.

The first housing 512 can be made of plastic, and a replaceable rubber sleeve can be placed outside of the housing 512, as described in greater detail below with respect to FIG. 12. Alternately, the first housing 512 can be made of rubber itself. The rubber described here can be a soft and hygienic surgical material so that it does not affect the teeth of a user. The second housing 514 can be made of plastic. At least one of the first housing 512 and the second housing 514 can be water-proof.

A combination of the first housing 512 and the second housing 514 can have a length of two inches. In another implementation, this length can be between 1.8 inches and 2.2 inches. In a yet another implementation, this length can be between 1.5 inches and 2.5 inches. The second housing 514 can have a width of 0.75 inches. These length and width can further vary in different implementations. The length and width are selected to facilitate or enhance the usability of the light device 102 by a user.

The light device 102 can be incorporated within a mask configured to be worn by a user. Some examples of such a mask include a surgical mask, a firefighter's facial gear, apparatus covering a portion of an engineer's face, and the like. In some implementations, the mask as well as the light device 102 can be disposable such that they can be disposed after every use. Alternately, the light device 102 can be hung on a lanyard around the neck of the user such that it is easily accessible by the mouth of that user. A user can, at will, remove the light device 102 from the lanyard and re-connect the light device 102 to the lanyard.

The one or more light emitting diodes 510 include a plurality of light emitting diodes placed at a plurality of locations within the light device 102. In one implementation, these locations can include two ends along a length of the light device 102. These two ends are exemplary locations, and, in other implementations, the light emitting diodes 510 can be placed by the manufacturer of the light device 102 at any location on the body of light device 102. In one implementation, different light emitting diodes can have different colors. Those different colored light emitting diodes can be activated based on corresponding patterns of pressure on the first tact switch 504 by the mouth of the user. In an alternate implementation, different patterns of pressure on the first tact switch 504 and/or the second tact switch 506 can cause different patterns of activation and/or deactivation of different light emitting diodes regardless of their color.

Figure 6:
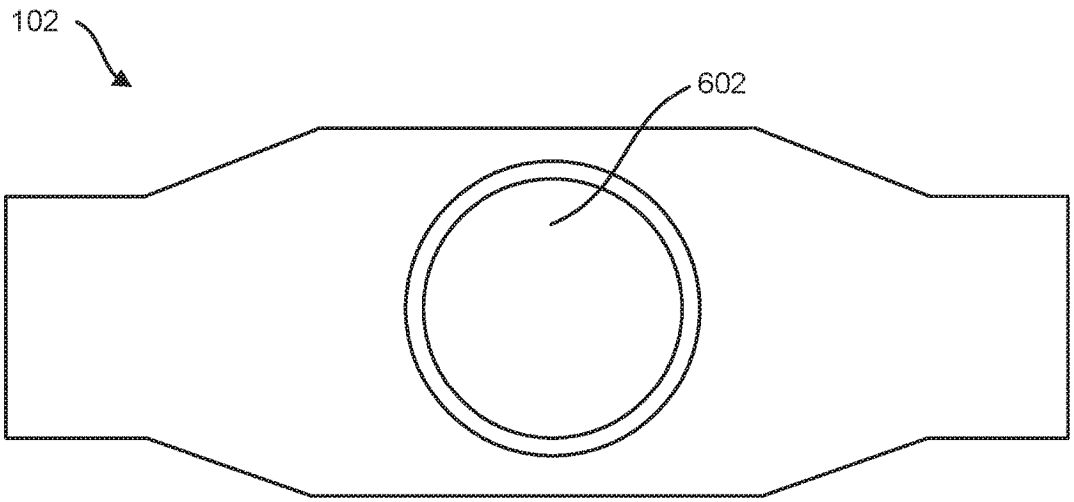
FIG. 6 is a top view of the of the light device shown in FIG. 5.

FIG. 6 illustrates a top view of the light device 102. This view shows the button 602 that overlies and is electrically connected to the second tact switch 506 (described above with respect to FIG. 5). When the button 602 is pressed, the second tact switch 506 also gets pressed and activated. The activation of the second tact switch 506 activates the one or more light emitting diodes 510. Thus, the individual is able to activate the one or more light emitting diodes 510 by using his or her hands as well, if required or desired so by that individual. While the button 602 is described here as being actuated by the hands of a user, any other body part or external thing can alternately be used as a substitute for the hands. If the one or more light emitting diodes are activated or turned on, a pressure on either of the first tact switch 504 and the second tact switch 506 can deactivate or turn off the already activated light.

Figure 7:
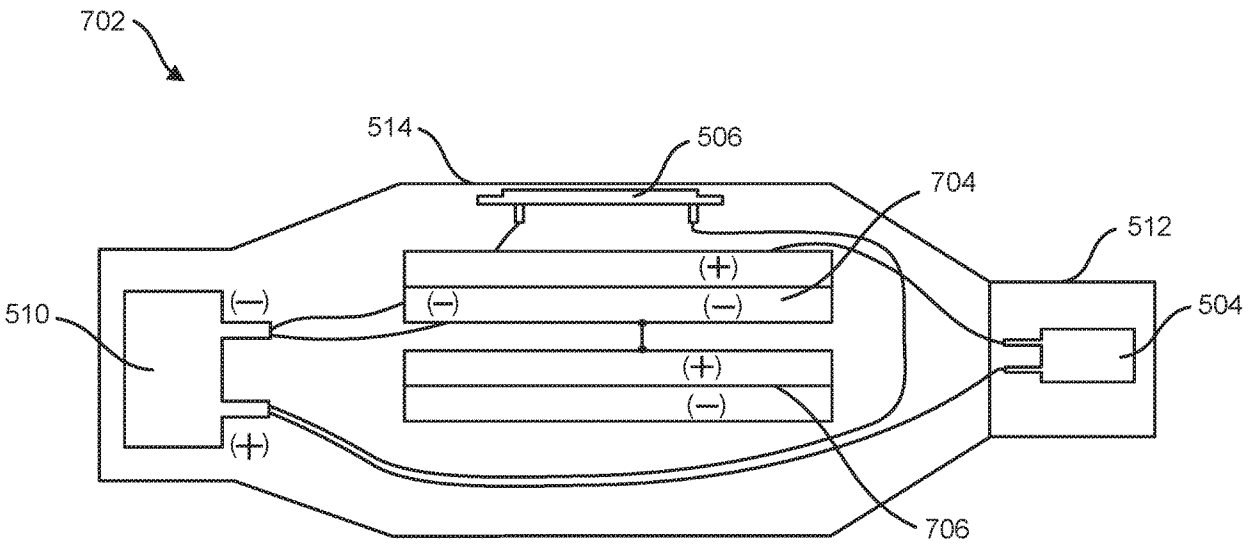
FIG. 7 is a side view of another exemplary embodiment of a light device.

FIG. 7 shows another exemplary embodiment of a light device 702. The light device 702 can generally be similar to the light device 102, but can include a different number of batteries. For example, the light device 702 includes two separate batteries 704 and 706 rather than a single battery 508. The light device 702 can generally function similarly to the light device 102. Specifically, when a user presses on the first housing 512 with his or her mandibles, the first tact switch 504 is pressed and activated. The activation of the first tact switch 504 activates the one or more light emitting diodes 510. Thus, the individual is able to activate the one or more light emitting diodes 510 without using his or her hands. If the one or more light emitting diodes are activated or turned on, a pressure on either of the first tact switch 504 and the second tact switch 506 can deactivate or turn off the already activated light.

The light device 702 is preferred over the light device 102 when more luminous intensity is desired.

Figure 8:
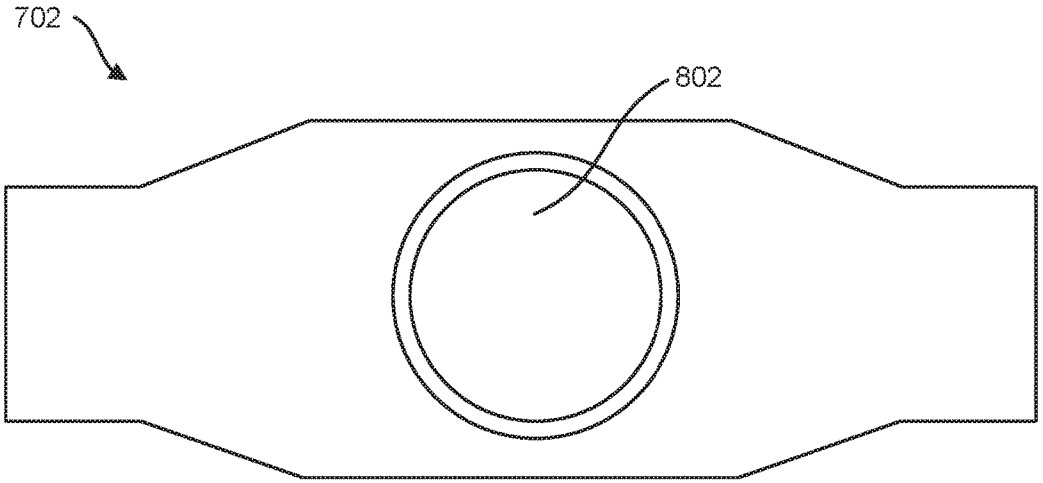
FIG. 8 is a top view of the of the light device shown in FIG. 7.

FIG. 8 illustrates a top view of the slight device 702. This view shows a button 802 that overlies and is electrically connected to the second tact switch 506 (described above with respect to FIG. 7). When the button 802 is pressed, the second tact switch 506 also gets pressed and activated. The activation of the second tact switch 506 activates the one or more light emitting diodes 510. Thus, the individual is able to activate the one or more light emitting diodes 510 by using his or her hands as well, if required or desired so by that individual. While the button 802 is described here as being actuated by the hands of a user, any other body part or external thing can alternately be used as a substitute for the hands.

Figure 9:
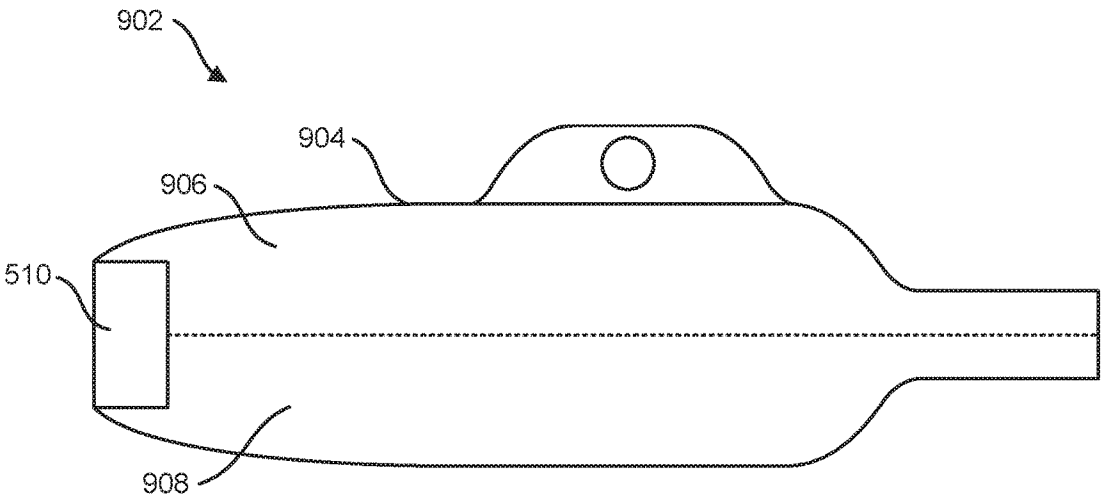
FIG. 9 is a side view of another exemplary embodiment of a light device.

FIG. 9 another embodiment of a light device 902 that includes a housing 904. In the illustrated example, while the internal circuitry can be the same as that described above with respect to the light devices 102, 702, the housing 904 is different. The housing 904 can include two separate halves 906 and 908. At the front of the light device 102 (that is, at the left-most point in FIG. 9), the two halves 906 and 908 join together to form an O-shaped ring.

The two halves 906 and 908 can be made of plastic. The portion of the housing 904 that is configured to be placed in the mouth of a user can be made of rubber. When that individual presses on the rubber portion with his or her mandibles, the first tact switch 504 is pressed and activated. The activation of the first tact switch 504 activates the one or more light emitting diodes 510. Thus, the individual is able to activate the one or more light emitting diodes 510 without using his or her hands.

The two halves 906 and 908 can be connected by screws, grooves, and/or the like. The portion of the housing 904 outside the one or more light emitting diodes 510 can be covered by a clear plastic, which ensures waterproofing as well.

Figure 10:
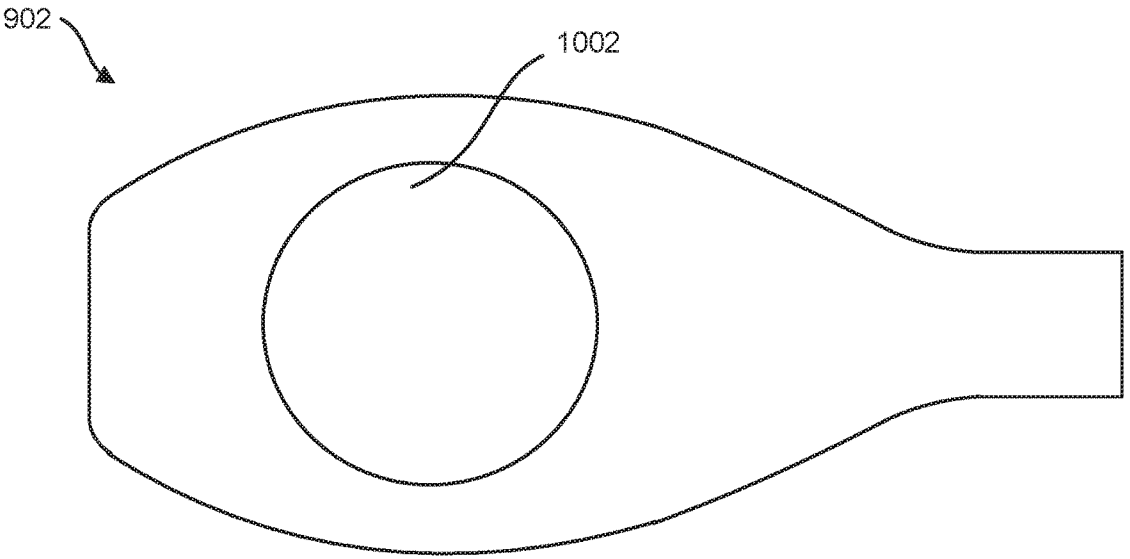
FIG. 10 is a top view of the light device shown in FIG. 9.

FIG. 10 illustrates a top view of another exemplary embodiment of a light device 902. The light device 902 can generally be similar to the light device 702, but can include a button 1002 that overlies and is electrically connected to the second tact switch 506 that underlies the rubber portion discussed above with respect to FIG. 9. When the button 1002 is pressed, the second tact switch 506 also gets pressed and activated. The activation of the second tact switch 506 activates the one or more light emitting diodes 510. Thus, the individual is able to activate the one or more light emitting diodes 510 by using his or her hands as well, if required or desired so by that individual. While the button 1002 is described here as being actuated by the hands of a user, any other body part or external thing can alternately be used as a substitute for the hands.

Figure 11:
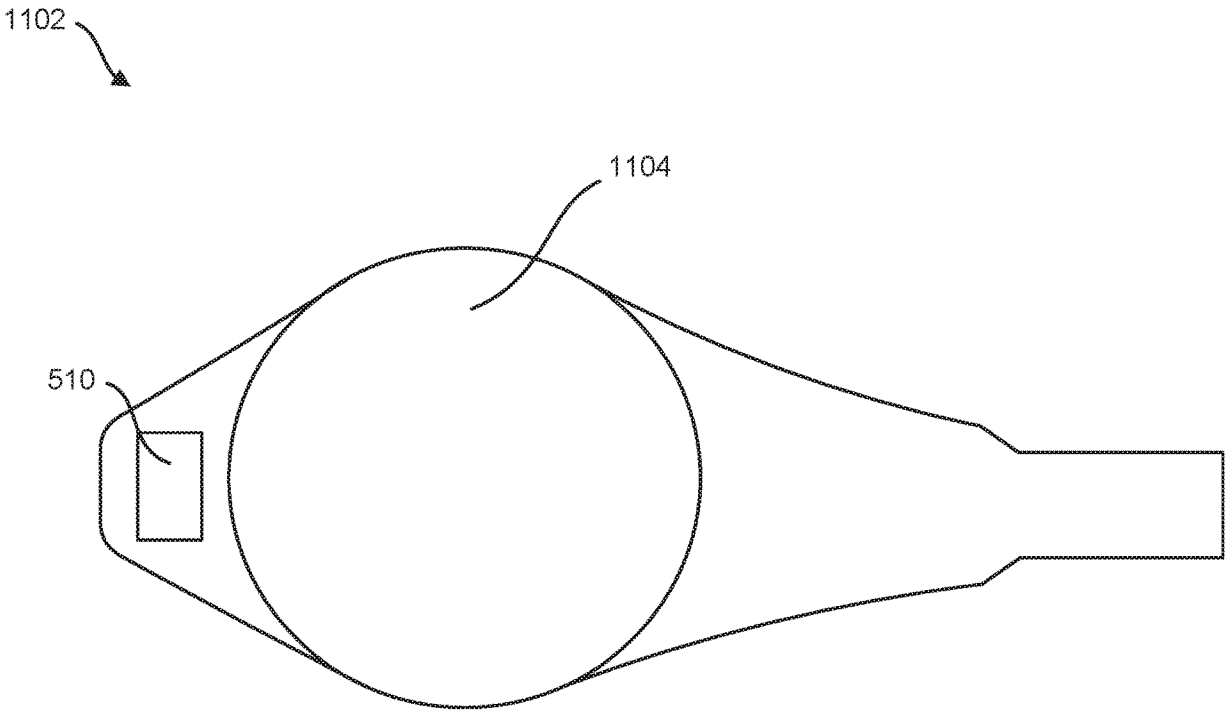
FIG. 11 is another exemplary embodiment of a light device.

FIG. 11 shows another exemplary embodiment of a light device 1102. The light device can generally be similar to the light devices 102, 702, 902, but can include a housing 1106 that has a shape of a whistle. The light device 1102 includes a battery 1104 and the one or more light emitting diodes 510, described above with regard to the light emitting diodes 102, 702. The light device 1102 can be configured to provide light, as well as function as a whistle. The electrical connections in the light device 1102 1102 can be the same as, or similar to, those shown in either FIG. 5 or FIG. 7.

Figure 12:
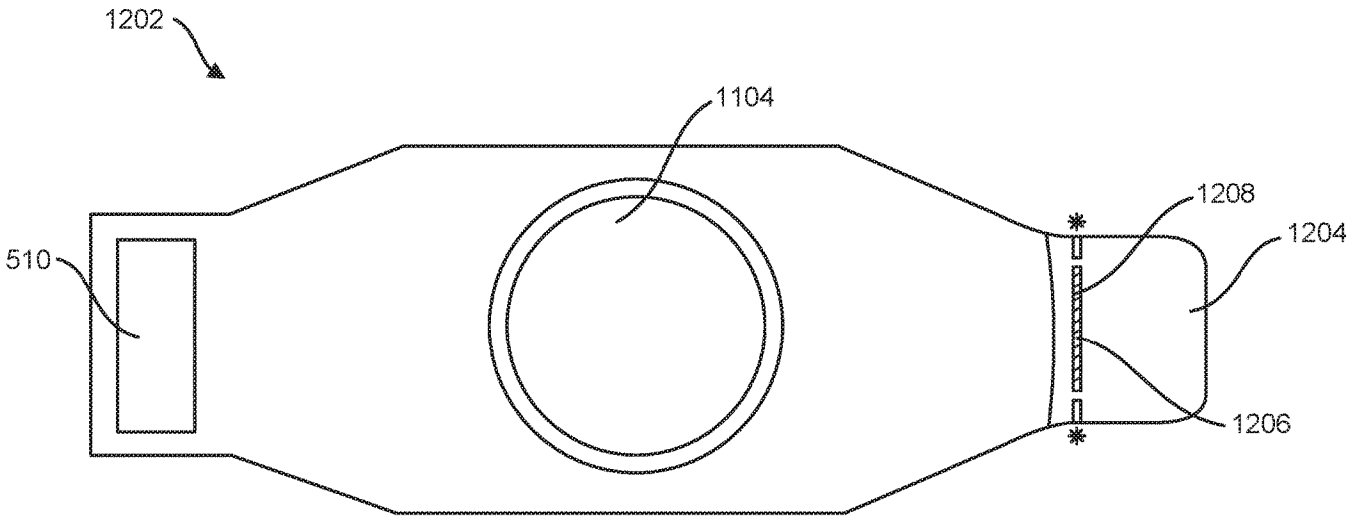
FIG. 12 is a top view of another exemplary embodiment of a light device.

FIG. 12 shown another exemplary embodiment of a light device 1202. The light device 1202 can generally be similar to the light devices 102, 702, described above. In the illustrated example, a first housing (obscured) of the light device 1202 can be overlaid by a replaceable sleeve 1204. The replaceable sleeve 1204 may be disposable. The first housing may include a mating element 1206 that can mate with a mating element 1208 embedded on the replaceable sleeve 1204. The mating elements 1206 and 1208 can be a ridge and a groove, respectively. In another implementation, the mating elements 1206 and 1208 can be a groove and a ridge, respectively. In one implementation, the ridge and the groove can form a watertight seal. The electrical connections and/or component of the light device 1202 can be the same as or similar to those shown in either FIG. 5 or FIG. 7.

Using the replaceable sleeve 1204 can be advantageous for the oral hygiene of a user, especially because the light device 1102 may be used by multiple users. While the sleeve 1204 is described as replaceable, in other implementations, the sleeve 1204 may be permanently attached on the first housing. In yet another implementation, the sleeve 1204 may form the first housing rather than being an element that overlays the first housing. In implementations where the sleeve 1204 is not easily replaceable, the sleeve 1204 may be washable in order to ensure that the sleeve 1204 remains hygienic. In such a case, the sleeve 1204 is made of a water-proof material.

Figure 13:
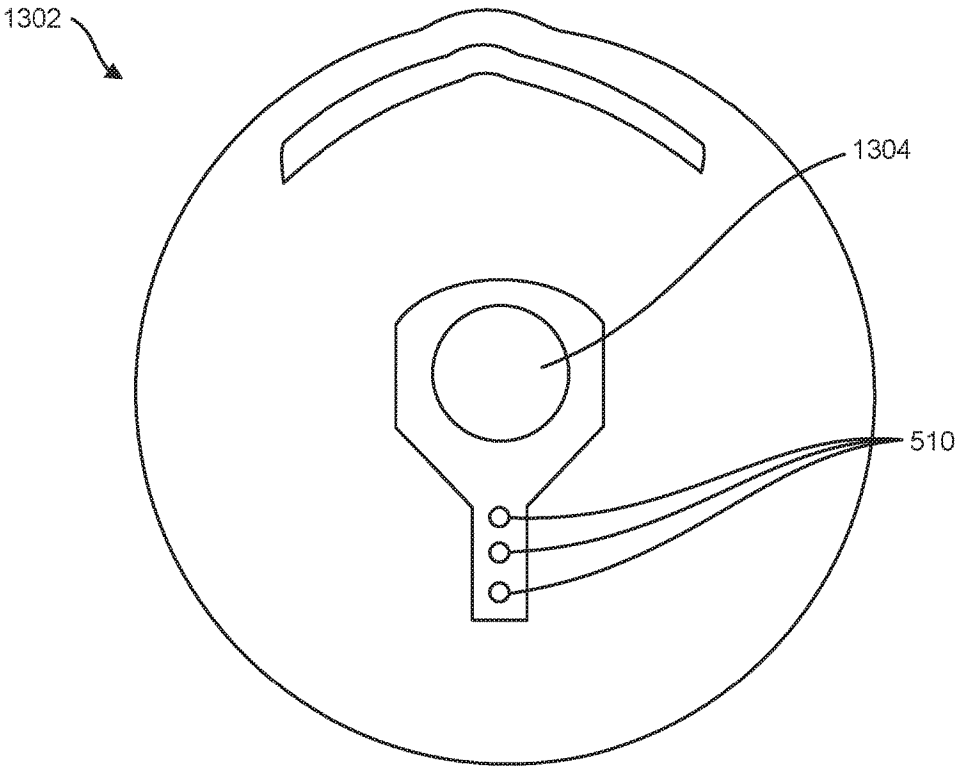
FIG. 13 is a front view of another exemplary embodiment of a light device.

FIG. 13 shows a front-view of another exemplary embodiment of a light device 1302 integrated into a mask, which can be a filtering or surgical mask. The light device 102 includes an exhale valve 1304, and one or more light emitting diodes 510. Other elements of the circuitry have not been shown for simplicity. The structure of the illustrated embodiment of the light device 1302 is beneficial because it integrates the mandible actuated light into the mask, such as the filtering or surgical mask. In one implementation, the mask can be disposable.

Figure 14:
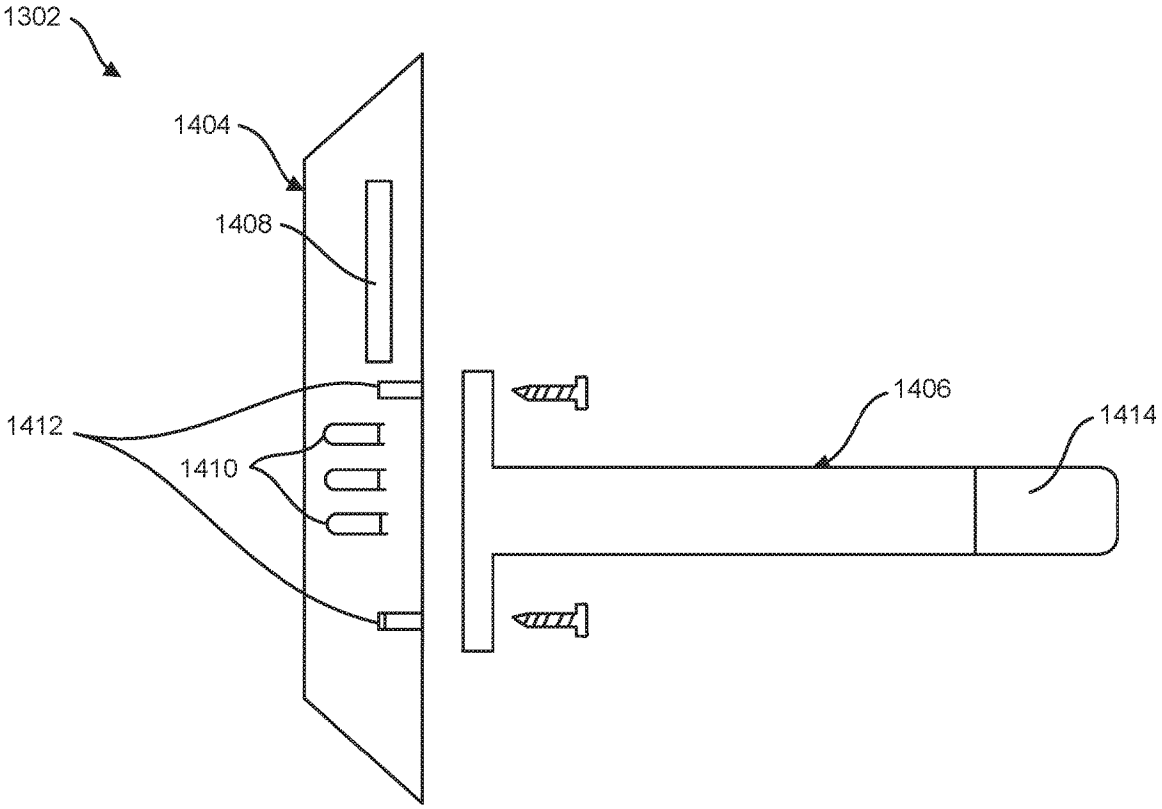
FIG. 14 is a side view of the light device shown in FIG. 13.

FIG. 14 illustrates a side view of the implementation of the light device 102 shown in FIG. 13. The light device 1302 includes a front section 1404 and a stem section 1406. The front section 1404 houses a battery 1408, light emitting diodes 1410, and threaded holes 1412 for securing a fastener. The stem section 1406 can include a tact switch 1414. The length of the stem section 1406 can be sufficiently large to enable the tact switch 1414 to be placed within reach of a user when the user wears a facial apparatus, such as a surgical mask, a welding mask or the like. In an alternate implementation, the length of the stem section 1406 can be variable such that the length can be varied by the user. In another variation, different implementations can have different lengths, which may or may not be variable.

The front section 1404 and the stem section 1406 can click together while puncturing a hole in the mask that can be sealed once the sections 1404 and 1406 are pressed together. This sealing can be performed using any snap apparatus that can be used instead of the screws. The sealing or snapping of sections 1404 and 1406 can activate the electrical circuit to activate the light device 1302.

The light device 1302 can be removable from the mask. All of the light devices 102, 702, 902, 1102, 1202, 1302, including embodiments that can be formed by combining different elements of the light devices 102, 702, 902, 1102, 1202, 1302 can be water proof, thereby rendering the light devices 102, 702, 902, 1102, 1202, 1302 washable.

While different implementations have been described above, this listing of embodiments is not exhaustive. Different elements of different embodiments of the light devices 102, 702, 902, 1102, 1202, 1302 and/or the like, can be combined to form another embodiment. Every such embodiment is within the scope of this patent application.

Further, some alternative implementations can include additional elements that are not described above. For example, one implementation can include a receiver and/or transmitter that enable the light devices 102, 702, 902, 1102, 1202, 1302 to communicate with computing systems via communication networks, such as local area network, a wide area network, internet, intranet, Bluetooth network, infrared network, and/or other communication networks. This can advantageously enable a technician to remotely troubleshoot the light devices 102, 702, 902, 1102, 1202, 1302 in case of an emergency. It can also enable collection of data such as times of activation and deactivation of the one or more light emitting diodes 510 of each particular light devices 102, 702, 902, 1102, 1202, 1302. This collected data can advantageously enable a technician to generate analytics for each device. In another implementation, the light devices 102, 702, 902, 1102, 1202, 1302 can include at least one data processor and a memory. The memory can store data, such as times when the light devices 102, 702, 902, 1102, 1202, 1302 should be automatically turned on, and the processor can activate the one or more light emitting diodes 510 at those times. Other electronic components, which enable the light devices 102, 702, 902, 1102, 1202, 1302 to act as a "smart" device, are also within the scope of this patent application, and may be included within the light devices 102, 702, 902, 1102, 1202, 1302.

Various implementations of the subject matter described herein can be realized/implemented in digital electronic circuitry, integrated circuitry, specially designed application specific integrated circuits (ASICs), computer hardware, firmware, software, and/or combinations thereof. These various implementations can be implemented in one or more computer programs. These computer programs can be executable and/or interpreted on a programmable system. The programmable system can include at least one programmable processor, which can be have a special purpose or a general purpose. The at least one programmable processor can be coupled to a storage system, at least one input device, and at least one output device. The at least one programmable processor can receive data and instructions from, and can transmit data and instructions to, the storage system, the at least one input device, and the at least one output device.

These computer programs (also known as programs, software, software applications or code) can include machine instructions for a programmable processor, and can be implemented in a high-level procedural and/or object-oriented programming language, and/or in assembly/machine language. As can be used herein, the term "machine-readable medium" can refer to any computer program product, apparatus and/or device (for example, magnetic discs, optical disks, memory, programmable logic devices (PLDs)) used to provide machine instructions and/or data to a programmable processor, including a machine-readable medium that can receive machine instructions as a machine-readable signal. The term "machine-readable signal" can refer to any signal used to provide machine instructions and/or data to a programmable processor.

Although a few variations have been described in detail above, other modifications can be possible. For example, the logic flows described herein do not require the particular order shown, or sequential order, to achieve desirable results. Other embodiments may be within the scope of the claims.

What is claimed is:

1. A device comprising:

a first housing, the first housing encompassing a first tact switch; and a second housing attached to and continuous with the first housing, the second housing encompassing a second tact switch, a battery, and one or more light emitting diodes, the first tact switch electrically connected to the battery and the one or more light emitting diodes, the second tact switch electrically connected to the battery and the one or more light emitting diodes, the battery further connected to the one or more light emitting diodes, each of the first tact switch and the second tact switch configured to be activated upon being pressurized by an external force upon a portion of the first housing or the second housing, respectively, to activate the one or more light emitting diodes.

2. The device of claim 1, wherein the each of the first tact switch and the second tact switch are configured to be deactivated upon being pressurized by at least one external force upon the portion of the first housing or the second housing, respectively, the deactivated tact switch deactivating the one or more light emitting diodes.

3. The device of claim 1, wherein the first tact switch is configured to be activated or deactivated by force applied by mandibles of a user.

4. The device of claim 1, wherein the first housing is encompassed with a replaceable sleeve.

5. The device of claim 1, wherein the first housing and replaceable sleeve mate via a ridge on the first housing and a groove on the replaceable sleeve.

6. The device of claim 1, wherein the first housing and replaceable sleeve mate via a groove on the first housing and a ridge on the replaceable sleeve.

7. The device of claim 4, wherein the first housing is made of plastic.

8. The device of claim 1, wherein the first housing is a replaceable sleeve.

9. The device of claim 8, wherein the first housing is made of rubber.

10. The device of claim 1, wherein the second tact switch is configured to be activated or deactivated by force applied by one or more fingers of a user.

11. The device of claim 1, wherein the second housing is made of plastic.

12. The device of claim 1, wherein the second housing is water-proof.

13. The device of claim 1, wherein the first housing is water-proof.

14. The device of claim 1, wherein a combination of the second housing and the first housing comprise two separate halves along a length of the light device.

15. The device of claim 14, wherein the two halves are combined via screws and grooves.

16. The device of claim 1, wherein a combination of the second housing and the first housing has a length of two inches.

17. The device of claim 1, wherein the second housing has a width of 0.75 inches.

18. The device of claim 1, wherein a combination of the second housing and the first housing is incorporated within a mask configured to be worn by a user.

19. The device of claim 1, wherein the one or more light emitting diodes includes a plurality of light emitting diodes, the plurality of the light emitting diodes being placed at a plurality of locations within a combination of the second housing and the first housing.

20. The device of claim 1, wherein the plurality of locations comprises two ends along a length of a combination of the second housing and the first housing.

* * * * *